United States Patent [19]

Tsuchiya

[11] Patent Number: 5,018,370

[45] Date of Patent: May 28, 1991

[54] CENTRAL STITCH CONTROLLING APPARATUS FOR CIRCULAR KNITTING MACHINE

[75] Inventor: Koji Tsuchiya, Nishinomiya, Japan

[73] Assignee: Precision Fukuhara Works, Ltd., Hyogo, Japan

[21] Appl. No.: 531,129

[22] Filed: May 31, 1990

[30] Foreign Application Priority Data

Jun. 9, 1989 [JP] Japan ..... 1-67447[U]

[51] Int. Cl.[5] ..... D04B 15/32

[52] U.S. Cl. ..... 66/55

[58] Field of Search ..... 66/27, 54, 55

[56] References Cited

U.S. PATENT DOCUMENTS 1,078,681 11/1913 Houseman ..... 66/55
2,012,607 8/1935 Houseman ..... 66/55 X
4,331,007 5/1982 Marchisio ..... 66/55

FOREIGN PATENT DOCUMENTS 1008860 5/1957 Fed. Rep. of Germany ..... 66/55
2156866 10/1985 United Kingdom ..... 66/55
2170827 8/1986 United Kingdom ..... 66/27

*Primary Examiner*—Wm. Carter Reynolds
*Attorney, Agent, or Firm*—Bell, Seltzer, Park & Gibson

[57] ABSTRACT

A central stitch length controlling apparatus for simultaneously varying the length of stitch loops being knit and optionally the positioning of the yarn guides (31) in a multi-feed circular knitting machine. The apparatus includes a vertically adjustable inner knitting cam block support ring (6, 47) which supports the knitting cams (7) and optionally the yarn guides (31) thereon. A plurality of sprocket wheels (18, 38) is disposed around the inner knitting cam block support ring (6, 47) and a fixed outer ring (16, 43). Rotation of the sprocket wheels (18, 38) selectively raises and lowers the inner knitting cam block support ring (6, 47). A sprocket chain (19, 46) drivingly interconnects the sprocket wheels (18, 38) to each other and may be manually rotated for simultaneously imparting like rotational movement to each of the sprocket wheels (18, 38) to thereby selectively raise or lower the inner knitting cam block support ring (6, 47) and the knitting cams (7) supported thereby.

7 Claims, 3 Drawing Sheets

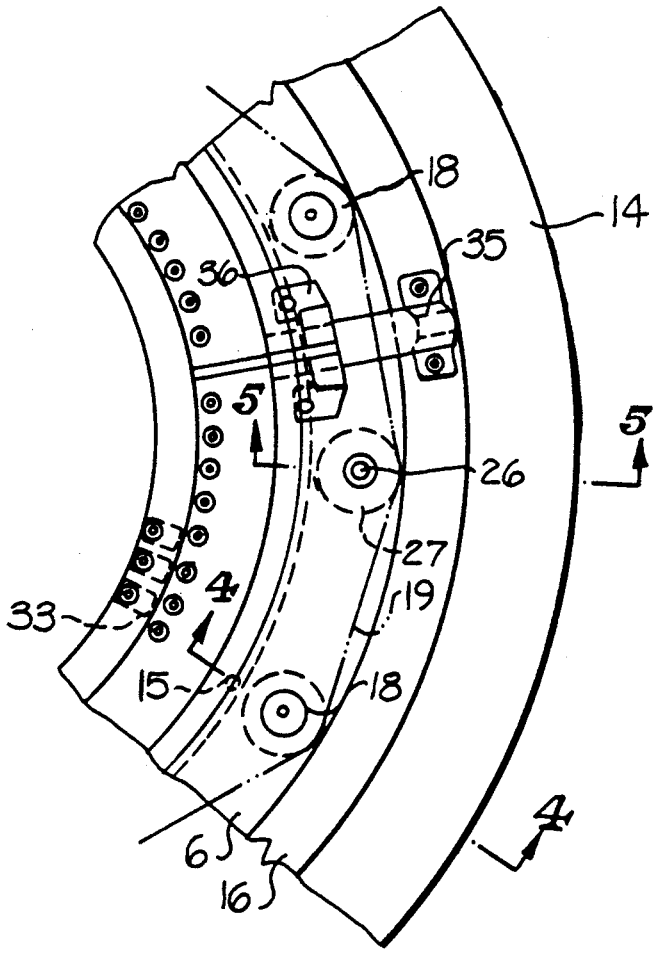
Fig-3
Fig-4
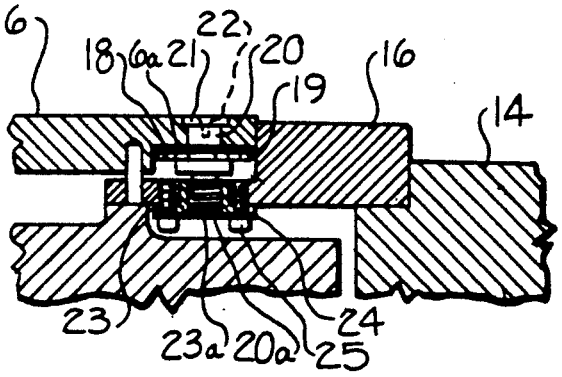
Fig-5
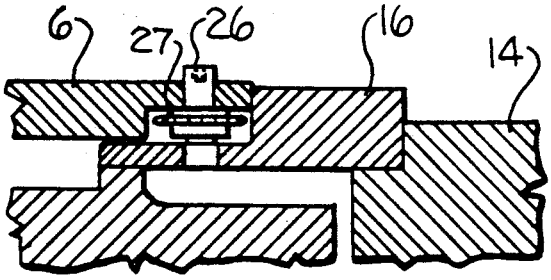

CENTRAL STITCH CONTROLLING APPARATUS FOR CIRCULAR KNITTING MACHINE

FIELD OF THE INVENTION

This invention relates generally to a central control device for simultaneously varying the length of stitch loops being formed at each of the knitting stations of a multi-feed circular knitting machine, and more particularly to such a central stitch length control device in which a plurality of wheel elements is disposed between a vertically movable inner knitting cam block support ring and a fixed outer ring and wherein rotational movement of the wheel elements imparts corresponding raising and lowering movement to the inner knitting cam block support ring for simultaneously varying the length of the stitch loops being formed at each of the knitting stations.

BACKGROUND OF THE INVENTION

It is the usual practice to change the length of stitch loops being formed on a multi-feed circular knitting machine by vertically adjusting the individual stitch cams at each of the yarn feeding and knitting stations to provide a vertical adjustment of the operating paths of the knitting needles to produce a knit fabric of a desired density. Adjusting the vertical position of the individual knitting cams is quite time consuming and requires a highly skilled operator in order to insure that all of the knitting stations are producing stitch loops of the same length.

This type of individual stitch length control adjustment is particularly difficult when using compound needles where the adjustment of the path of travel of the needles may extend beyond the normal feeding position of the yarn guides at the particular knitting station. Therefore, the changing of the stitch density of the fabric also requires individual adjustment of the yarn guide positions to correspond with the change in the path of travel of the needles. This individual adjustment of the position of the yarn guides at each of the knitting stations is also time consuming and requires a skilled operator. The larger the number of yarn feeders and yarn guides associated with the knitting machine, the longer the time required to change the individual stitch cams and the yarn feeding fingers or guides at each knitting station.

In order to solve the problem of providing individual adjustment of the stitch cams and the yarn guides at each knitting station, it has been proposed to provide a central control apparatus for the simultaneous adjustment of the stitch length and the position of the yarn guides at each knitting station by providing a threaded outer peripheral surface on the inner knitting cam block supporting ring, and a threaded adjustment ring surrounding the inner knitting cam block supporting ring. Rotational movement of the adjustment ring imparts corresponding vertical raising and lowering movement to the inner knitting cam block supporting ring to simultaneously adjust the stitch length being formed at each of the knitting stations. When the yarn carrier ring support and the yarn guides are mounted on the inner knitting cam block supporting ring, they are also simultaneously adjusted as the stitch length is adjusted. This arrangement does provide for simultaneous adjustment of the stitch length and adjustment of the yarn guides. However, a large gear-driving apparatus is required in this device to enable the inner knitting cam block supporting ring to be raised or lowered, and this type of large threaded gear-driving apparatus must have the threaded mating parts manufactured to very close tolerances, thereby increasing the manufacturing costs.

SUMMARY OF THE INVENTION

With the foregoing in mind, it is an object of the present invention to provide a central stitch length controlling apparatus for simultaneously varying the length of stitch loops, and the positioning of the yarn guides, by a relatively unskilled operator, and with a large amount of cost reduction for the inner knitting cam block support ring raising and lowering means.

In accordance with the present invention, the central stitch length controlling apparatus includes knitting cams supported on knitting cam blocks at each feed of the knitting machine. An inner knitting cam block supporting ring is supported for vertical movement surrounding the needle cylinder and inside of an outer fixed ring. The invention is characterized in that the vertical raising and lowering of the inner knitting cam block supporting ring includes a plurality of wheels disposed between the inner knitting cam block supporting ring and the outer fixed ring. The shafts of the wheel elements are threaded so that rotation of the wheel elements imparts corresponding raising and lowering movements to the inner knitting cam block support ring.

In a second embodiment of the central stitch length controlling apparatus, the yarn guides at each of the knitting stations are supported by the vertically movable inner knitting cam block supporting ring so that the vertical position of the yarn guides is simultaneously changed as the inner knitting cam block supporting ring is raised or lowered to simultaneously adjust the positions of the knitting cams and knitting cam blocks carried thereby at each knitting station.

In each embodiment of the invention, each of the wheel elements is drivingly interconnected to each other by transmission linkage, in the form of a chain or toothed timing belt. Movement of the transmission chain or toothed timing belt is provided by at least one wheel-driving shaft projecting above the surface of the inner knitting cam block support ring for simultaneously imparting like rotational movement to each of the wheel elements and to selectively raise or lower the inner knitting cam block support ring. The rotational movement of the wheel elements imparts selected raising or lowering movement to the inner knitting cam block supporting ring so that the knitting cams and knitting cam blocks supported thereon are simultaneously raised and lowered at each knitting station. In the second embodiment, both the knitting cams and the yarn guides are raised and lowered as the inner knitting cam block supporting ring is raised and lowered so that both the stitch length is adjusted, as well as the position of the yarn guides at each of the knitting stations.

BRIEF DESCRIPTION OF THE DRAWINGS

Other objects and advantages will appear as the description proceeds when taken in connection with the accompanying drawings, in which ——

FIG. 3 is a fragmentary plan view of a portion of the inner knitting cam block supporting ring and associated parts;

FIG. 4 is a fragmentary vertical sectional view, at an enlarged scale, being taken substantially along the line 4—4 in FIG. 3;

FIG. 5 is a view similar to FIG. 4 but being taken substantially along the line 5—5 in FIG. 3;

DESCRIPTION OF THE ILLUSTRATED EMBODIMENTS

Figure 1:
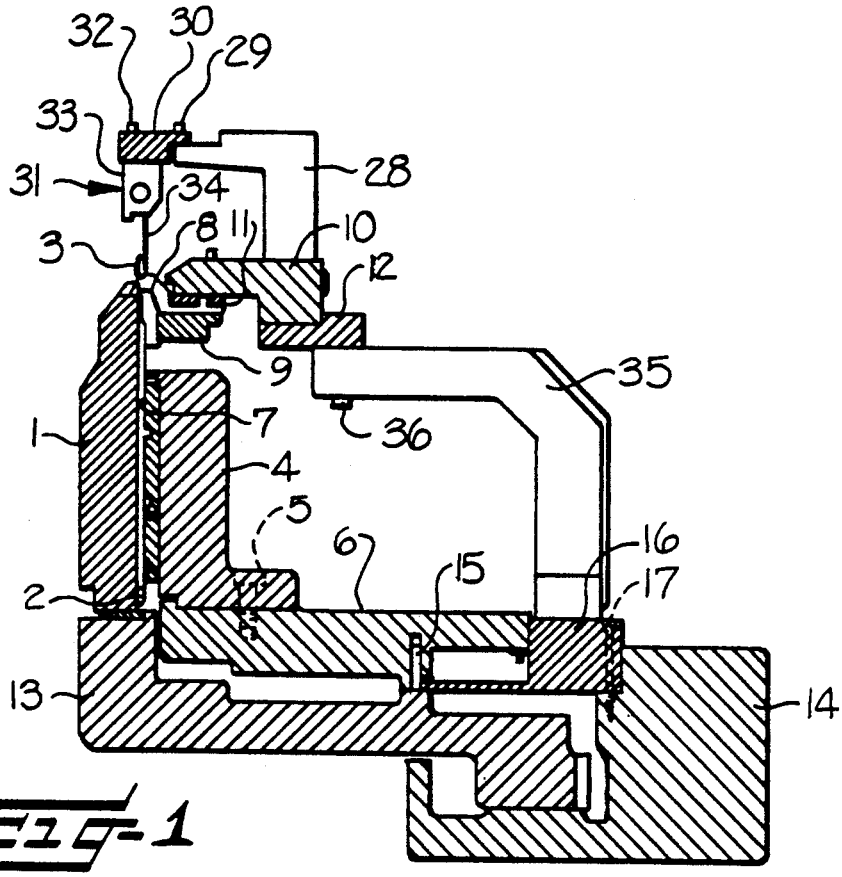
FIG. 1 is a vertical sectional view through the needle cylinder of the knitting machine and illustrating the first embodiment of the present invention.
Figure 2:
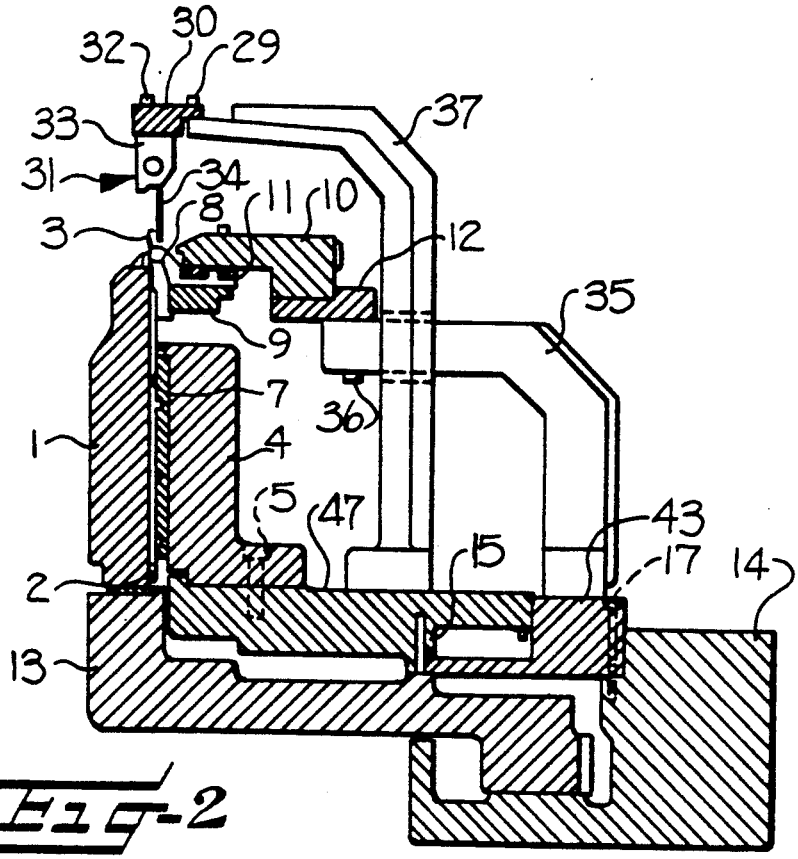
FIG. 2 is a view similar to FIG. 1 but illustrating a second embodiment of the invention.

Referring particularly to FIGS. 1 and 2, the knitting machine includes a needle cylinder 1 having vertically extending needle grooves or slots 2 formed in the outer peripheral surface thereof and supporting needles 3 for vertical movement therein. Knitting cam blocks 4 extend around the needle cylinder 1 and are fixed to the upper surface of an inner knitting cam block supporting ring, indicated at 6 in FIG. 1 and at 47 in FIG. 2. The knitting cam blocks 4 are fixed to the respective inner knitting cam block supporting rings 6, 47 by screws 5. The knitting cam blocks 4 support the usual knitting cams 7 for controlling the vertical movement of the knitting needles 3 at each of the yarn feeding and knitting stations. A sinker 8 operates in association with each of the knitting needles 3 and is supported for radial sliding movement on a sinker dial 9 disposed in a horizontal plane. The sinkers 8 are actuated and controlled by sinker cams 11 fixed to the lower surface of a sinker cap 10. The sinker cap 10 is retained on a sinker cap support ring 12. A cylinder driving gear 13 is connected to the lower end of the needle cylinder 1 to rotate the needle cylinder 1 in the usual manner.

A bed plate 14 supports the drive gear 13 and surrounds the inner knitting cam block supporting ring 6, 47, and also supports an outer ring, indicated at 16 in FIG. 1 and at 43 in FIG. 2, which is held in position on the bed plate 14 by screws 17. As will be noted in FIGS. 1 and 2, the outer peripheral surface of the inner knitting cam block supporting rings 6, 47 extend over and are spaced above the inner peripheral portions of the corresponding outer rings 16, 43 and are prevented from rotation relative to each other by a guide pin 15 fixed in the outer ring 16, 43 and extending upwardly into the corresponding inner knitting cam block supporting ring 6, 47.

As indicated in FIG. 1, four to six yarn carrier ring support brackets 28 are fixed at their lower ends on the sinker cap 10 at equal intervals. The forward or upper ends of the yarn carrier ring support brackets 28 are fixed to a yarn carrier ring 30 as by screws 29. Yarn guides, broadly indicated at 31, are fixed to the lower surface of the yarn carrier ring 30 with screws 32. The yarn guide 31 is provided with a holder 33 and a yarn carrier or feed finger 34 for guiding the yarn to the needles 3 at each of the yarn feeding stations. Cap ring support brackets 35 are arranged at equal intervals with their lower ends being fixed on the outer cam ring 16. Each of the cap ring support brackets 35 is substantially aligned with the corresponding yarn carrier ring support bracket 28 and the upper end is fixed to the cap ring 12, as by screws 36.

As illustrated in FIG. 1, the inner knitting cam block supporting ring 6 is supported inside of the outer ring 16 for independent vertical movement and means is provided for raising and lowering the inner knitting cam block support ring 6 relative to and independently from the outer ring 16. The raising and lowering means for the inner knitting cam block support ring 6 is illustrated in FIGS. 3 and 4 as including about six equally spaced wheel elements 18, only two of which are shown in FIG. 3, supported for rotation between the outer peripheral portion of the inner knitting cam block support ring 6 and the inner peripheral portion of the outer cam ring 16. The outer peripheral portion of the inner knitting cam block support ring 6 is spaced above and overlies the inner peripheral portion of the outer cam ring 16. The wheel elements 18 are illustrated as being sprocket wheels which are drivingly interconnected by transmission means, in the form of an endless chain 19 engaging the outer peripheral surface of each of the sprocket wheels 18. If desired, a toothed timing belt and timing pulleys or other suitable mechanisms can be used in place of the sprocket wheels 18 and the endless chain 19.

Figure 6:
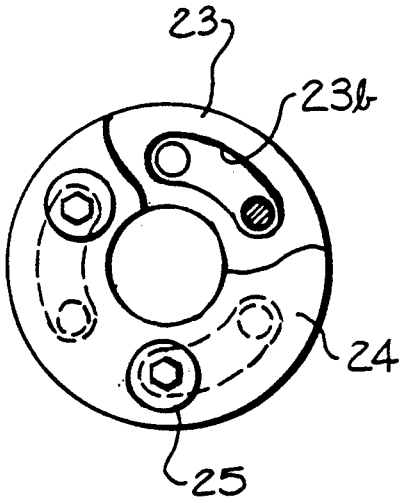
FIG. 6 is a view of the lower side of the plate and bearing supporting the wheel element shown in FIG. 4.

As illustrated in FIG. 4, the sprOcket wheel 18 is provided with a vertical shaft 20 having portions extending upwardly and downwardly therefrom. An end plate 21 is fixed to the upper end of the shaft 20, as by a screw 22, for preventing axial movement of the shaft 20. The upper surface of the sprocket wheel 18 is provided with a shoulder which abuts on the under surface 6*a* of the inner knitting cam block supporting ring 6 so that the vertical position of the sprocket wheel 18 is fixed, relative to the inner knitting cam block supporting ring 6. The lower end portion of the vertical shaft 20 is provided with an external screw thread 20*a* which is engaged with an internal screw thread portion 23*a* of a bearing 23. As shown in FIG. 6, three elongated holes or slots 23*b* are formed on the circumferential flange of the bearing part 23 so that these holes or slots 23*b*, in any position the bearing part 23 is supported, may fit into any of the three of the six bolt holes drilled at equal intervals on the underside of the outer cam ring 16. A plate 24 is disposed just below the bearing part 23 and fixed to the underside of the outer ring 16 with screws 25.

At least one sprocket wheel 27, having a driving shaft 26 projecting from the upper surface of the inner knitting cam block supporting ring 6 (FIGS. 3 and 5), is supported for rotation between the adjusting sprocket wheels 18. The sprocket wheel 27 is adapted to be rotated by the use of a tool placed in the upper end of the driving shaft 26, such as a hexagonal wrench. The sprocket wheel 27 is thus rotated in the desired direction and the series of sprocket wheels 18 is also turned by means of the endless chain 19 engaging the teeth of the sprocket wheel 27. Rotation of the sprocket wheels 18 thus selectively raises and lowers the inner knitting cam block supporting ring 6, through means of the external threads 20*a* and the internal threads 23*a*. The inner knitting cam block supporting ring 6 will thus be raised or lowered, depending upon the direction of the rotation imparted to the sprocket wheels 18 by the chain 19 and the rotation of the sprocket wheel 27. In the embodiment of the invention thus far described, the raising and lowering of the inner knitting cam block supporting ring 6 simultaneously increases and decreases the stitch length being formed by correspondingly raising and lowering the knitting cams 7 supported by the knitting cam blocks 4 and the inner knitting cam block supporting ring 6. However, the raising and lowering of the inner knitting cam block supporting ring 6, in accordance with the first embodiment of the invention, does not affect the vertical position of the yarn guides 34 at each of the yarn feeding and knitting stations since the yarn guides 34 are supported in a fixed position by the outer fixed ring 16.

Figure 7:
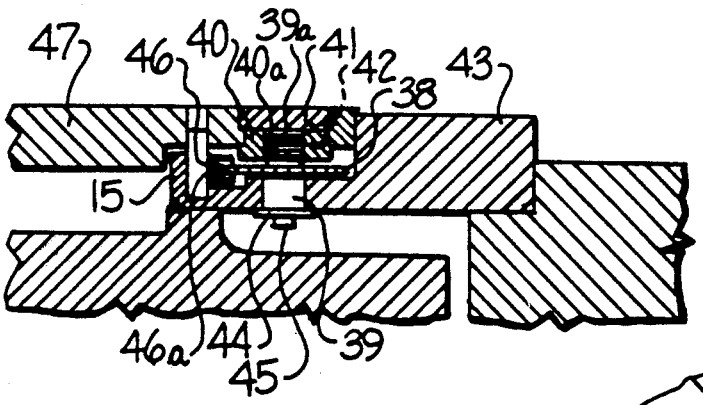
FIG. 7 is a view similar to FIG. 4 but illustrating a different embodiment of wheel element for raising and lowering the inner knitting cam block support ring.
Figure 8:
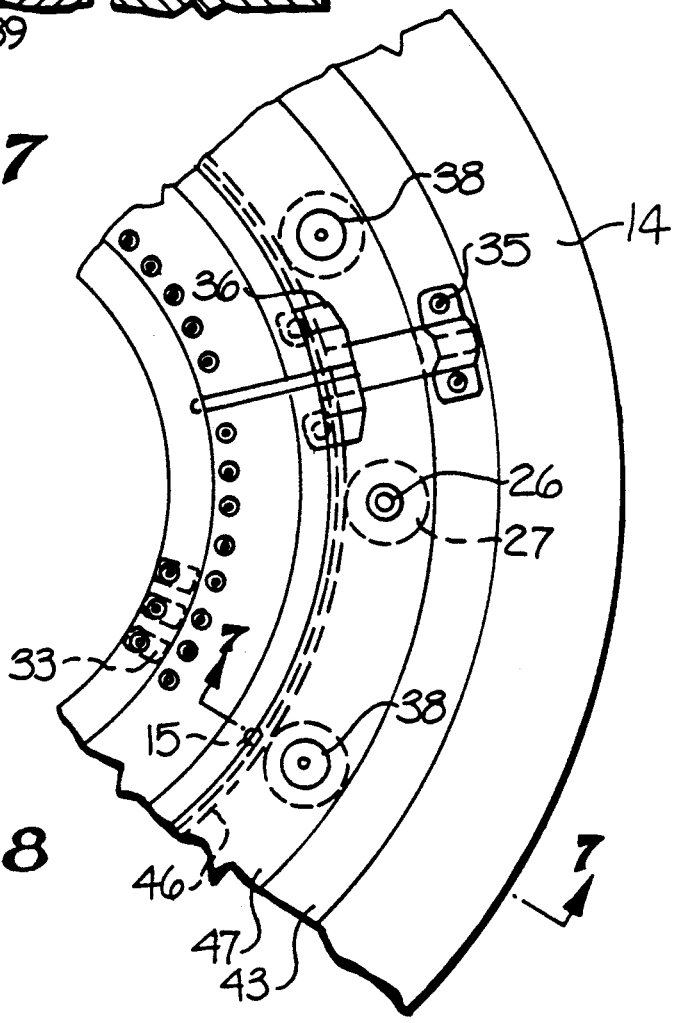
FIG. 8 is a view similar to FIG. 3 but showing the second embodiment of the wheel elements and the wheel element transmission driving means.

A second embodiment of the adjusting wheel elements is illustrated in FIGS. 7 and 8. As illustrated in FIG. 7, sprocket wheels 38 are provided with a vertical shaft 39. The upper end portion of the vertical shaft is provided with an external screw thread 39*a* which is engaged with an internal screw thread 40*a* of a bearing part 40. The bearing part 40, as well as an end plate 41, is fixed with screws 42. The lower end of the vertical shaft 39 is rotatably supported in the inner peripheral portion of an outer cam ring 43. The lower end of the vertical shaft 39 is provided with an end plate 44, fixed thereto with a screw 45, to prevent vertical movement of the sprocket wheel 38 when it is rotated. As illustrated in FIG. 8, the transmission means for imparting rotation to the sprocket wheels 38 is illustrated in the form of an endless chain 46 which extends around on a guide track 46*a* on the inner peripheral portion of the outer ring 43. Between at least a pair of sprocket wheels 38 there is provided at least one sprocket wheel 27 having a driving shaft projecting from the upper surface of the inner knitting cam block support ring 47, in the same manner as that described for the first embodiment. Thus, the sprocket wheel 27 may be rotated to simultaneously rotate each of the sprocket wheels 38 and thereby selectively raise or lower the inner knitting cam block supporting ring 47.

As noted in FIG. 2, four to six yarn carrier ring support brackets 37 are disposed at equal intervals with their lower ends being fixed on the inner knitting cam block supporting ring 47. The upper ends of the carrier ring support brackets 37 are fixed to and support the carrier ring 30 and the yarn carriers 34 supported thereon. The cap ring support brackets 35 each pass through an opening or slot in the yarn carrier ring support brackets 37 and have their lower ends fixed on the outer cam ring 43. The upper inner ends of the cap ring support brackets 35 are fixed on the ring 12 as by screws 36 and support the sinker cap 10 in a fixed position. Thus, in the second embodiment of FIGS. 2, 7 and 8, the raising or lowering of the inner knitting cam block supporting ring 47 imparts a like amount of raising or lowering of the yarn carriers 34. In both embodiments of the invention, the inner knitting cam block supporting ring 6 or 47 is independently movable in a vertical upward and downward direction relative to the corresponding outer ring 16 or 43. In the first embodiment, the vertical movement of the inner knitting cam block supporting ring 6 does not change the vertical position of the yarn feed fingers or carriers 34 while vertical raising or lowering of the inner knitting cam block supporting ring 47 does correspondingly raise and lower the position of the yarn guides 34. In both embodiments, the mechanism to raise and lower the inner knitting cam block supporting ring 6 or 47 independently of the outer ring 16 or 43 provides simple sprocket wheels 18 or 38 and a chain drive for transmitting rotation to each of the sprocket wheels in a simple manner thereby enabling the manufacture of the apparatus at a low cost. The present apparatus also insures easy adjustment of the stitch length at each of the knitting stations in a short period of time, without requiring skilled operators, and thereby improving productivity and performing the adjustment at less expense.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A central stitch length controlling apparatus for a multi-feed circular knitting machine of the type including knitting cams (7) supported on knitting cam blocks (4) at each feed thereof, an inner knitting cam block supporting ring (6, 47), an outer ring (16, 43) surrounding and supporting said inner ring (6, 47), and means for raising and lowering said inner knitting cam block support ring (6, 47) relative to and independently from said outer ring (16, 43), said central stitch controlling apparatus being characterized in that said inner knitting cam block support ring raising and lowering means comprises a plurality of wheel elements (18, 38) disposed between said inner knitting cam block support ring (6, 47) and said outer ring (16, 43), thread means (20*a*, 23*a* and 39*a*, 40*a*) operatively associated with said wheel elements (18, 38) for raising and lowering said inner knitting cam block support ring (6, 47) with corresponding rotation of said wheel elements (18, 38), transmission means (19, 46) drivingly interconnecting said wheel elements to each other, and wheel element driving means (26) for imparting movement to said transmission means (19, 46) for simultaneously imparting like rotational movement to each of said wheel elements (18, 38) and to selectively raise or lower said inner knitting cam block support ring (6, 47).

2. A central stitch length controlling apparatus according to claim 1 wherein said knitting machine includes at least one yarn guide at each feed, and including support means for supporting said yarn guides on said inner knitting cam block supporting ring (47) so that the position of said yarn guides (34) relative to the needles (3) is also varied as said inner knitting cam block supporting ring (47) is selectively raised or lowered.

3. A central stitch length controlling apparatus according to claim 1 wherein said wheel elements (18, 38) each comprise a sprocket wheel, and wherein said transmission means (19, 46) comprises a sprocket chain in engagement with each of said sprocket wheels.

4. A central stitch length controlling apparatus according to claim 1 wherein said inner knitting cam block support ring (6, 47) includes an outer peripheral portion, and said outer ring (16, 43) includes an inner peripheral portion underlying and spaced below said outer peripheral portion of said inner knitting cam block, wherein said wheel elements (18, 38) are positioned between said outer peripheral portion of said inner knitting cam block support ring (6, 43) and said inner peripheral portion of said outer ring (16, 43) and include upper and lower vertical shaft portions supported for rotation in the respective outer peripheral portion of said inner knitting cam block support ring (6,

47) and the inner peripheral portion of said outer ring (16, 43).

5. A central stitch length controlling apparatus according to claim 4 wherein said thread means (20*a*, 23*a* and 39*a*, 40*a*) is associated with one of said upper and lower vertical shaft portions of said wheel elements (18, 38) and wherein said thread means (20*a*, 23*a* and 39*a*, 40*a*) is operable to raise and lower said inner knitting cam block support ring (6, 47) with rotation of said wheel elements (18, 38).

6. A central stitch length controlling apparatus according to claim 5 wherein said thread means (20*a*, 23*a*) is associated with said lower shaft portion of said wheel elements (18) for selectively raising or lowering said inner knitting cam block support ring (6).

7. A central stitch length controlling apparatus according to claim 5 wherein said thread means (39*a*, 40*a*) is associated with said upper shaft portion of said wheel elements (38) for selectively raising or lowering said inner knitting cam block support ring (47).

* * * * *